US005326097A

United States Patent [19]

Yu

[11] Patent Number: 5,326,097

[45] Date of Patent: * Jul. 5, 1994

[54] RACKET FOR PLAY AND SPORTS

[76] Inventor: Chien P. Yu, No. 15, Lane 251, Tung Yang Rd., Tung Yang Li, Feng Yuan City, Taichung Hsien, Taiwan

[ * ] Notice: The portion of the term of this patent subsequent to Jul. 21, 2009 has been disclaimed.

[21] Appl. No.: 857,824

[22] Filed: Mar. 26, 1992

[51] Int. Cl.[5] ..... A63B 59/18

[52] U.S. Cl. ..... 273/67 R

[58] Field of Search ..... 273/67, 73, 411

[56] References Cited

U.S. PATENT DOCUMENTS

| | | | |
|---|---|---|---|
| 3,048,399 | 8/1962 | Breitbach | 273/73 R |
| 3,162,443 | 12/1964 | Petri | 273/73 R |
| 3,734,499 | 5/1973 | Goldstein | 273/73 E |
| 4,330,124 | 5/1982 | Vettorello | 273/67 B |
| 4,844,478 | 7/1989 | Kessler | 273/411 |
| 5,131,653 | 7/1992 | Yu | 273/73 R |
| 5,217,222 | 6/1993 | Radell et al. | 273/67 R |

FOREIGN PATENT DOCUMENTS

| | | | |
|---|---|---|---|
| 496281 | 10/1919 | France . | |
| 8503300 | 1/1987 | Netherlands | 273/73 C |

*Primary Examiner*—Mark S. Graham

*Attorney, Agent, or Firm*—Varndell Legal Group

[57] ABSTRACT

A racket including a pair of frames each having a head portion and a handle portion formed integral with each other, an annular space formed between the head portions, and an envelope engaged on a ring which is engaged in the annular space formed by the head portions of the frames, whereby, the envelope and the ring can be easily engaged in the head portions. The envelope forms a ball striking surface.

1 Claim, 2 Drawing Sheets

RACKET FOR PLAY AND SPORTS

BACKGROUND OF THE INVENTION

1. Field of the Invention

The present invention relates to a racket, and more particularly to a racket for play and sports.

2. Description of the Prior Art

One type of tennis racket is disclosed in U.S. Pat. No. 4,274,634 to Berluti, filed Nov. 29, 1979, entitled "TENNIS RACKETS". In this racket, the counter frame 6 and the outer rigid frame 4 are fixed to the annular support 2 by four or more screws 7. The frames 2, 4, 6 should be drilled with holes such that the screws 7 can be threadedly engaged. The strength of the frames will therefore decreased.

Another type of racket is disclosed in U.S. Pat. No. 3,734,499 to Goldstein, filed Dec. 28, 1971, entitled "RACKET WITH RESILIENT SURFACE". In this racket, in order to support the membrane 15, the rods 23, 24, 25, 26 should be assembled in the head portion 12 individually. The assembling operation thereof is complicated.

The present invention has arisen to mitigate and/or obviate the afore-described disadvantages of the conventional racket frames.

SUMMARY OF THE INVENTION

The primary objective of the present invention is to provide a racket in which the racket frame can be easily assembled.

In accordance with one aspect of the invention, there is provided a racket comprising a pair of frames engageable with each other, each of the frames including a head portion and a handle portion formed integral with each other, each of the head portions having an annular groove formed therealong, the grooves of the head portions forming an annular space when the frames are engaged with each other, a ring, and an envelope engaged on the ring, and the ring engaged in the annular space formed by the head portions of the frames, whereby, the envelope and the ring can be easily engaged in the head portions, and the envelope forms a ball striking surface.

The envelope is preferably made of resilient fabric including an opening formed therein for insertion of the ring. It is preferable that the ring has a hexagonal cross section.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
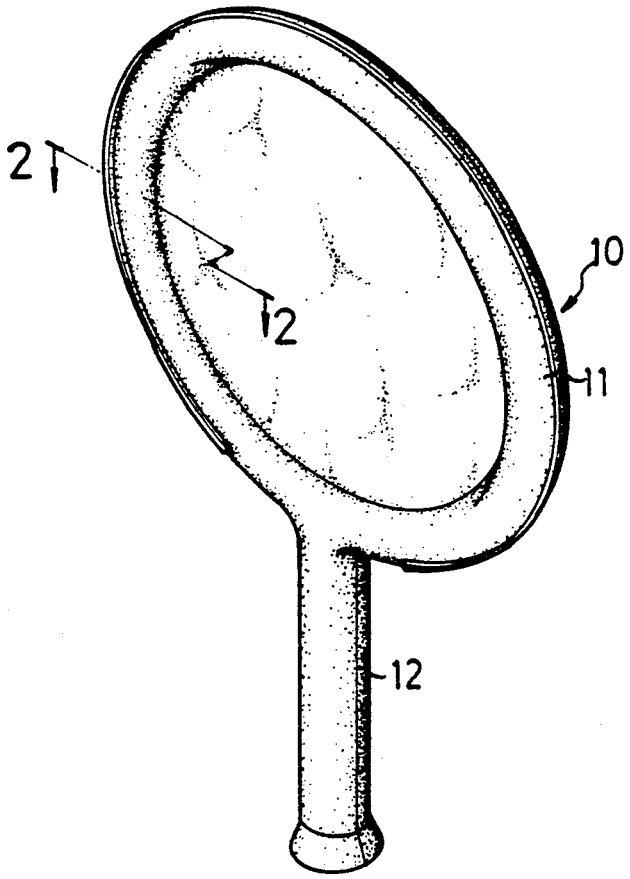
FIG. 1 is a perspective view of a racket in accordance with the present invention.

Referring to the drawings, a racket in accordance with the present invention comprises generally a pair of frames 10, 100 each including a head portion 11 and a handle portion 12 integrally formed together; a ring 20 engaged between the head portions 11 of the frames 10, 100; and a fabric 30 engaged on the ring 20 which is engaged in the head portion 11 of the frames 10, 100 so that the fabric 30 defines a ball striking surface.

The frames 10, 100 are preferably made of plastic materials so that the frames 10, 100, when abutted with each other, can be welded together by such as ultrasonic welding or high frequency heating processes. The head portion 11 can either be oval-shaped or circular-shaped having a recess 13 formed therearound. The recesses 13 of the head portions 11 form a ring-shaped space, such as circular or oval shaped space, when the frames 10, 100 are welded together. A plurality of projections 14 are formed in the radially outward portions of the recesses 13 of the first frame 10, and a plurality of hubs 101 are formed in the radially outward portions of the recess 13 of the second frame 100 for engagement with the projections 14 such that the frames 10, 100 can further be coupled together. An annular groove 15, 102 is formed in the radially inward portion of each of the frames 10, 100. The annular grooves 15, 102 form an annular space.

Figure 2:
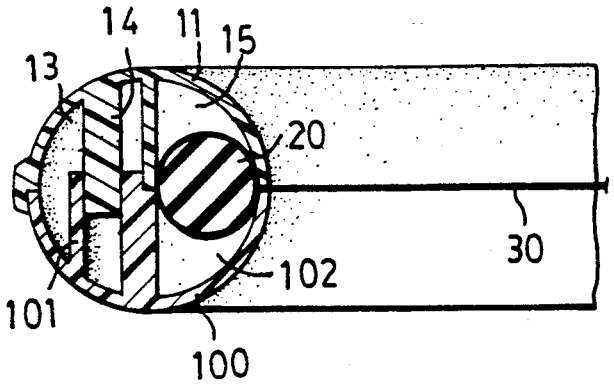
FIG. 2 is a cross sectional view taken along lines 2—2 of FIG. 1.
Figure 3:
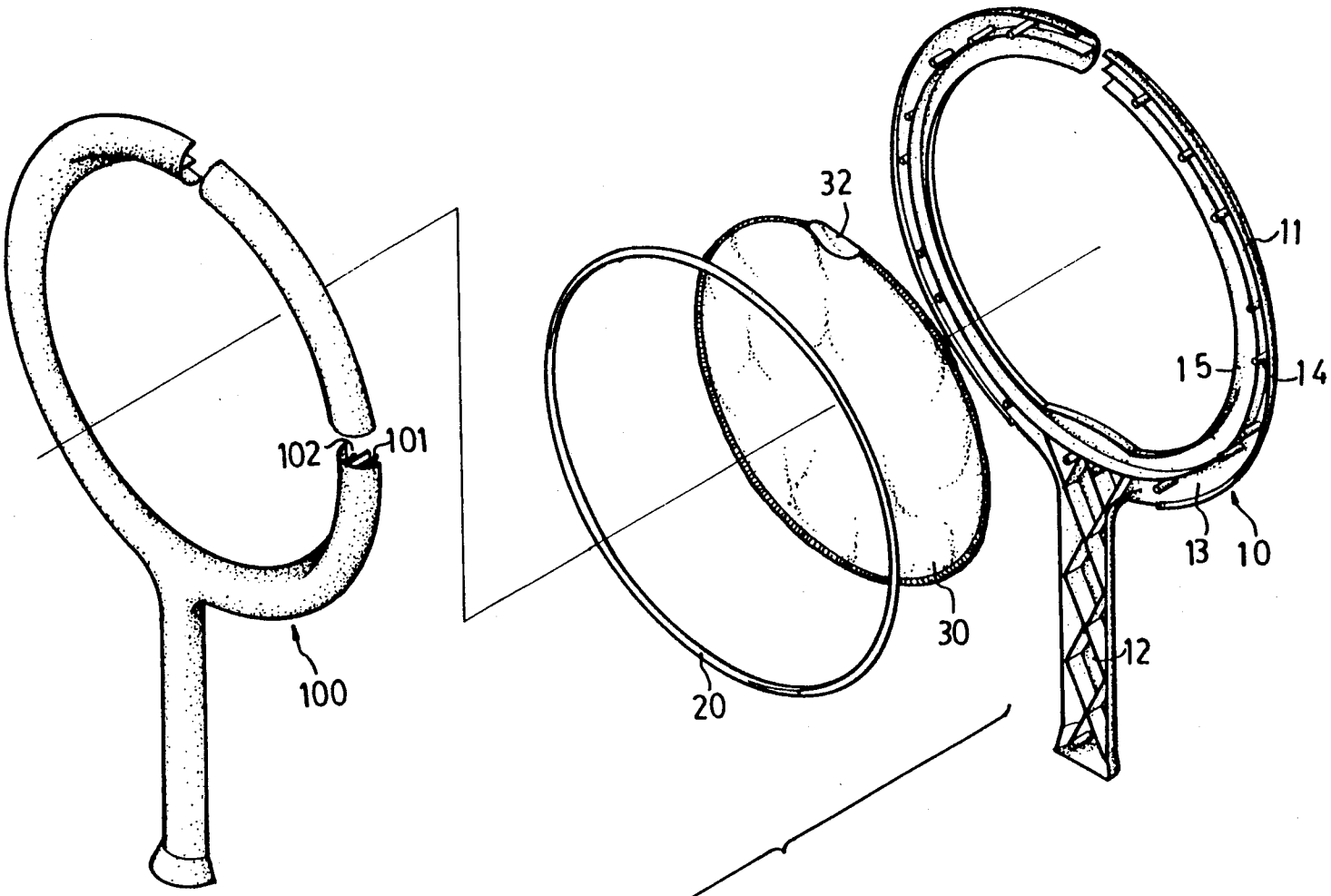
FIG. 3 is an exploded view of the racket.

The fabric 30 is formed as a circular envelope including two layers and having an outer peripheral portion corresponding to the shape of the ring 20 and having an opening 32 formed therein. The outer peripheral portions of the two layers of the fabric 30 are fixed together by such as stitching operations. The ring 20 is made of flexible materials, such as rubber or plastic so that the ring 20 can be inserted into the fabric envelope 30 via the opening 32. As best shown in FIG. 2, it is preferable that the ring 20 has a circular cross section. It is to be noted that the cross section of the ring 20 can also have other shape such as hexagonal cross section. One type of the resilient fabric 30 is the fabric for making swimsuit which has high resilience, the resilience facilitates the insertion of the ring 20 into the opening 32 of the fabric 30. The fabric 30 is slightly stretched outward by the ring 20 when the ring 20 is inserted into the fabric 30. The ring 20 has a shape corresponding to the annular shape formed by the annular grooves 15, 102 of the head portions 11 so that the ring 20 can be received and engaged in the annular space, best shown in FIG. 2.

Accordingly, the resilient fabric 30 of the racket can be easily engaged on the ring 20 which can be easily engaged between the frames 10, 100. The racket in accordance with the present invention can be used for striking any kind of balls which have light weight, such as tennis balls, balls for squash etc.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A racket comprising a ring, an envelope formed of resilient fabric encasing said ring, said envelope having an opening for insertion of said ring therein, and first and second frames each including a head portion and a handle portion formed integral with each other, each of said head portions including a radially inward portion having an annular grove formed therein and a radially outward portion, said head portion of said first frame including a plurality of stubs formed in said radially outward portion thereof, said head portion of said second frame including a plurality of hubs formed in said radially outward portion thereof engaged with said stubs of said head portion of said first frame for securing said first and second frames together, said grooves of said head portions forming an annular space when said frames are secured together, said ring having a size matching that of said annular space, said ring and a portion of said envelope of resilient fabric being held in said annular space encased by said head portions and arranged for said envelope to form a ball striking surface.

* * * * *